US011056059B2

(12) United States Patent
Li et al.

(10) Patent No.: US 11,056,059 B2
(45) Date of Patent: Jul. 6, 2021

(54) DISPLAY PANEL, METHOD OF DRIVING THE SAME, AND DISPLAY APPARATUS

(71) Applicant: BOE TECHNOLOGY GROUP CO., LTD., Beijing (CN)

(72) Inventors: Xiaolong Li, Beijing (CN); Wei Qin, Beijing (CN); Kuanjun Peng, Beijing (CN); Xueling Gao, Beijing (CN); Chengchung Yang, Beijing (CN); Zhiqiang Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/436,238

(22) Filed: Jun. 10, 2019

(65) Prior Publication Data

US 2019/0392768 A1 Dec. 26, 2019

(30) Foreign Application Priority Data

Jun. 21, 2018 (CN) ..... 201810646213.X

(51) Int. Cl.
*G09G 3/3266* (2016.01)

(52) U.S. Cl.
CPC ... *G09G 3/3266* (2013.01); *G09G 2300/0465* (2013.01); *G09G 2310/066* (2013.01);
(Continued)

(58) Field of Classification Search
CPC ..... G09G 3/3266; G09G 2300/0465; G09G 2310/066; G09G 2320/0257; G09G 2330/021; G09G 3/2014; G09G 2340/14; G09G 2310/08; G09G 2320/0214; G09G 2320/0252; G09G 2300/0866;
(Continued)

(56) References Cited

U.S. PATENT DOCUMENTS 6,191,433 B1 * 2/2001 Roitman ..... H01L 27/3281 257/40
8,736,180 B2 * 5/2014 Tsai ..... H05B 45/60 315/160
(Continued)

FOREIGN PATENT DOCUMENTS

CN 1801304 A 7/2006
CN 101034532 A 9/2007
(Continued)

OTHER PUBLICATIONS

First Office Action dated Sep. 4, 2019 corresponding to Chinese application No. 201810646213.X.

*Primary Examiner* — Bryan Earles
(74) *Attorney, Agent, or Firm* — Nath, Goldberg & Meyer; Joshua B. Goldberg

(57) ABSTRACT

The present application provides a display panel, a method of driving the same and a display apparatus. The display panel has pixel regions, each of which has pixel structures. Each of the pixel structures includes an anode, a cathode and a light emitting layer. The display panel further includes a controller and power signal lines coupled to the controller. Cathodes or anodes in a same pixel region are coupled to a same power signal line. The controller is configured to control a duty cycle of a control signal input to a power signal line coupled to a pixel region in response to a motion picture being displayed in the pixel region.

20 Claims, 7 Drawing Sheets

(52) U.S. Cl.
CPC ..... *G09G 2320/0257* (2013.01); *G09G 2330/021* (2013.01)

(58) Field of Classification Search
CPC ..... G09G 2300/0426; G09G 3/3225; G09G 3/3208; H01L 51/50–56; H01L 27/32–3297
See application file for complete search history.

(56) References Cited

U.S. PATENT DOCUMENTS

| | | | | |
|---|---|---|---|---|
| 2007/0103408 | A1* | 5/2007 | Tada | G09G 3/2014 345/76 |
| 2010/0103202 | A1* | 4/2010 | Seo | G09G 3/3426 345/690 |
| 2010/0177086 | A1* | 7/2010 | Nakamura | G09G 3/3258 345/211 |
| 2017/0169763 | A1 | 6/2017 | Bi et al. | |
| 2019/0044040 | A1* | 2/2019 | Andrews | H01L 33/46 |
| 2019/0114991 | A1* | 4/2019 | Selan | G09G 5/026 |

FOREIGN PATENT DOCUMENTS

| | | | |
|---|---|---|---|
| CN | 101373582 | A | 2/2009 |
| CN | 105047138 | A | 11/2015 |

* cited by examiner

DISPLAY PANEL, METHOD OF DRIVING THE SAME, AND DISPLAY APPARATUS

CROSS-REFERENCE TO RELATED APPLICATION

This application claims priority to Chinese Patent Application No. 201810646213.X, filed on Jun. 21, 2018, the entire contents of which are hereby incorporated by reference.

TECHNICAL FIELD

The present disclosure relates to the field of display technology, and particularly, to a display panel, a method of driving the same, and a display apparatus.

BACKGROUND

Organic light emitting diode (OLED) display apparatuses are self-emissive apparatuses, and do not require backlights. OLED display apparatuses also provide more vivid colors and a larger color gamut as compared to the conventional liquid crystal display (LCD) apparatuses. Further, OLED display apparatuses can be made more flexible, thinner, and lighter than typical LCD apparatuses. An OLED display apparatus typically includes an anode, an organic layer including a light emitting layer, and a cathode. OLEDs can be either a bottom-emission type OLED or a top-emission type OLED.

SUMMARY

In an aspect, the present disclosure provides a display panel having a plurality of pixel regions and including a base substrate, a respective one of the plurality of pixel regions having a plurality of pixel structures provided on the base substrate, and a respective one of the plurality of pixel structures including an anode, a cathode and a light emitting layer between the anode and the cathode, wherein the display panel further includes a controller, and a plurality of power signal lines in a one-to-one correspondence with the plurality of pixel regions, anodes or cathodes of the plurality of pixel structures in the respective one of the plurality of pixel regions are each coupled to a respective one of the plurality of power signal lines, and the controller is coupled with the plurality of power signal lines and configured to control a duty cycle of a control signal input to the respective one of the plurality of power signal lines in response to a motion picture being displayed in the respective one of the plurality of pixel regions.

In an embodiment, the display panel further includes a first signal line layer, an insulation layer and a second signal line layer sequentially provided in a direction perpendicular to the base substrate, the anode is on a side of the first signal line layer away from the second signal line layer, wherein in the respective one of the plurality of pixel regions, a plurality of first voltage signal lines arranged in columns are provided in the first signal line layer, the plurality of first voltage signal lines in the respective one of the plurality of pixel regions are insulated and spaced apart from a plurality of first voltage signal lines in any other one of the plurality of pixel regions, and a respective one of the plurality of first voltage signal lines in the respective one of the plurality of pixel regions is coupled to the anode; in the respective one of the plurality of pixel regions, a plurality of second voltage signal lines arranged in rows are provided in the second signal line layer, the plurality of second voltage signal lines in the respective one of the plurality of pixel regions are insulated and spaced apart from a plurality of second voltage signal lines in any other one of the plurality of pixel regions, and in the respective one of the plurality of pixel regions, the plurality of first voltage signal lines are coupled with the plurality of second voltage signal lines through a plurality of vias extending through the insulation layer; and the plurality of power signal lines are a plurality of first power signal lines, the plurality of first power signal lines are provided in the first signal line layer or the second signal line layer, and the plurality of second voltage signal lines in the respective one of the plurality of pixel regions are each coupled to a respective one of the plurality of first power signal lines.

In an embodiment, in the respective one of the plurality of pixel regions, the plurality of first voltage signal lines and the plurality of second voltage signal lines are provided to intersect to form a mesh structure, and the plurality of vias are provided at intersections of the mesh structure, respectively, and the mesh structure in the respective one of the plurality of pixel regions is insulated and spaced apart from a mesh structure in any other one of the plurality of pixel regions.

In an embodiment, the display panel is an organic light emitting diode display panel, and the plurality of first power signal lines are a plurality of electroluminescent voltage device signal lines.

In an embodiment, the cathodes are an integral cathode extending throughout the display panel and the integral cathode is coupled with the controller through a signal line.

In an embodiment, the cathodes in the respective one of the plurality of pixel regions are insulated and spaced apart from cathodes in any other one of the plurality of pixel regions, the plurality of power signal lines are a plurality of second power signal lines, and the cathodes in the respective one of the plurality of pixel regions are coupled to a respective one of the plurality of second power signal lines.

In an embodiment, a respective one of the plurality of second power signal lines is provided at a gap between two adjacent pixel regions of the plurality of pixel regions.

In an embodiment, the gap between the two adjacent pixel regions of the plurality of pixel regions has a width in a range of about 20 μm to about 40 μm.

In an embodiment, the display panel further includes a resin layer including a plurality of resin blocks arranged at intervals, wherein a respective one of the plurality of resin blocks is in the respective one of the plurality of pixel regions and on the light emitting layer; and the cathodes in the respective one of the plurality of pixel regions are on the respective one of the plurality of resin blocks and between the respective one of the plurality of resin blocks and an adjacent respective one of the plurality of the resin blocks.

In an embodiment, a cross section of the respective one of the plurality of resin blocks along a plane perpendicular to the base substrate has an inverted trapezoidal shape.

In an embodiment, the display panel is an organic light emitting diode display panel, and the plurality of second power signal lines are a plurality of electroluminescent voltage series signal lines.

In an embodiment, the duty cycle of the control signal is from about 10% to about 80%.

In an embodiment, a number of the plurality of pixel regions is from 2 to 16.

In another aspect, the present disclosure provides a display apparatus, including any one of the display panels described herein.

In another aspect, the present disclosure provides a method of driving a display panel. The display panel is any one of the display panels described herein. The method includes detecting, by the controller, whether a motion picture is displayed in the respective one of the plurality of pixel regions; and controlling, by the controller, a duty cycle of a control signal input to the respective one of the plurality of power signal lines, in response to detecting that the motion picture is displayed in the respective one of the plurality of pixel regions.

In an embodiment, controlling the duty cycle of the control signal input to the respective one of the plurality of power signal lines includes: for any frame of picture, inputting a low voltage level signal to the respective one of the plurality of power signal lines during a first period; and inputting a high voltage level signal to the respective one of the plurality of power signal lines during a second period.

In an embodiment, the duty cycle of the control signal is controlled such that the duty cycle is in a range of about 10% to about 80%.

In an embodiment, the method further includes controlling a data voltage input to a data line of the display panel in response to detecting that the motion picture is displayed in the respective one of the plurality of pixel regions, such that luminance of the plurality of pixel structures in the respective one of the plurality of pixel regions is compensated for.

DETAILED DESCRIPTION

To make the above objects, features and advantages of the disclosure more apparent, the present disclosure will be further described in detail below in conjunction with accompanying drawings and specific embodiments.

Compared to LCDs, OLED display apparatuses have advantages such as low power consumption, low production cost, self-luminescence, wide viewing angle and fast response speed.

Although the display response time of OLED is much faster than that of LCD, a severe trail phenomenon may still exist due to non-instantaneous change in luminance of the pixel from bright to dark. A straightforward method for alleviating the trail phenomenon is to increase the refresh rate. However, this method has higher requirements on the structures of circuits, and increasing the refresh rate will lead to significantly increased power consumption of the product.

Figure 1:
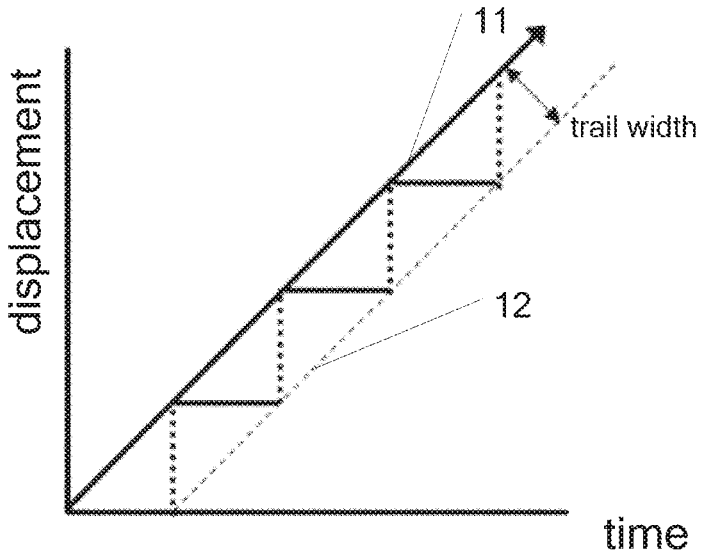
FIG. 1 is a schematic diagram illustrating a trail phenomenon of a display panel at a refresh rate of 120 Hz.
Figure 2:
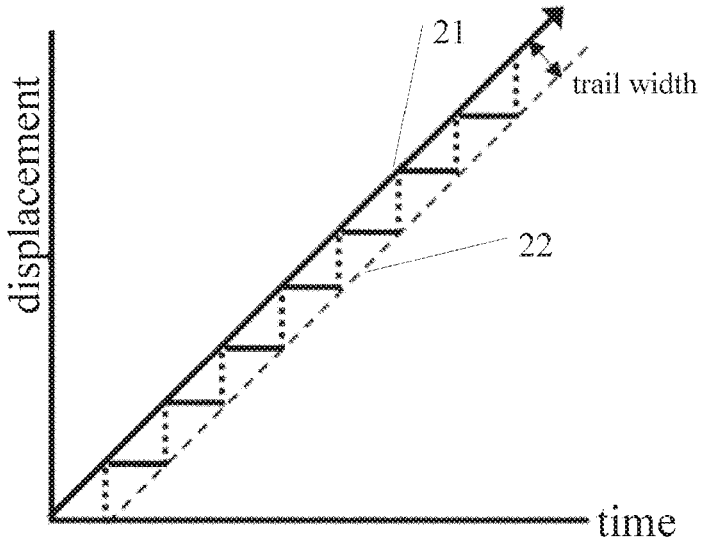
FIG. 2 is a schematic diagram illustrating a trail phenomenon of a display panel at a refresh rate of 240 Hz.

FIG. 1 is a schematic diagram illustrating a trail phenomenon of a display panel at a refresh rate of 120 Hz; FIG. 2 is a schematic diagram illustrating a trail phenomenon of a display panel at a refresh rate of 240 Hz; and FIG. 3 is a diagram illustrating the principle of alleviating a trail phenomenon according to an embodiment of the present disclosure.

Next, it is assumed that a motion picture (e.g., a moving football in FIG. 11 described later) is displayed in a display panel. In FIGS. 1 to 3, the horizontal axis represents time, and the vertical axis represents a displacement of an object (e.g., the football). For a motion picture consisting of multiple frames of pictures, when display of one frame of picture is completed, the next frame of picture is displayed by refreshing. For the multiple frames of pictures, the displacements corresponding to respective beginnings of the refreshing can form a straight line, for example, a straight line 11 in FIG. 1, a straight line 21 in FIG. 2, or a straight line 31 in FIG. 3, and the displacements corresponding to respective ends of the refreshing can also form a straight line, for example, a straight line 12 in FIG. 1, a straight line 22 in FIG. 2, or a straight line 32 in FIG. 3. A distance between the straight line corresponding to the beginnings of refreshing of the multiple frames of pictures and the straight line corresponding to the ends of the refreshing of the multiple frames of pictures refers to a trail width, for example, a distance between the straight line 11 and the straight line 12 in FIG. 1 is a trail width corresponding to the display panel at a refresh rate of 120 Hz, and a distance between the straight line 21 and the straight line 22 in FIG. 2 is a trail width corresponding to the display panel at a refresh rate of 240 Hz. It can be seen that the trail phenomenon of the display panel can be obviously alleviated by increasing the refresh rate thereof.

Figure 3:
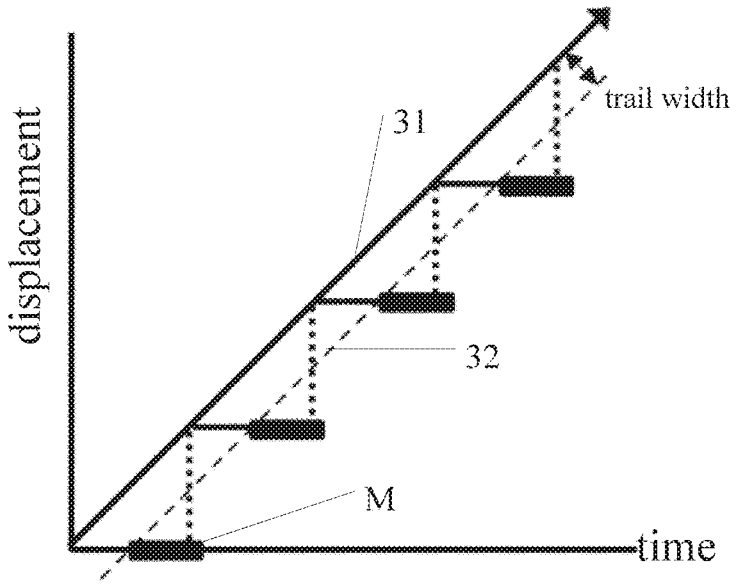
FIG. 3 is a diagram illustrating the principle of alleviating a trail phenomenon according to an embodiment of the present disclosure.

In an embodiment of the present disclosure, as illustrated in FIG. 3, a black picture M may be inserted into every frame of picture, such that the trail width between the straight line 31 and the straight line 32 is reduced. As a result, the display panel at a refresh rate of 120 Hz can achieve the same effect of alleviating the trail phenomenon as the display panel at a refresh rate of 240 Hz.

The present disclosure provides, inter alia, a display panel, a method of driving the same, and a display apparatus that substantially obviate one or more of the problems due to limitations and disadvantages of the related art.

Figure 4:
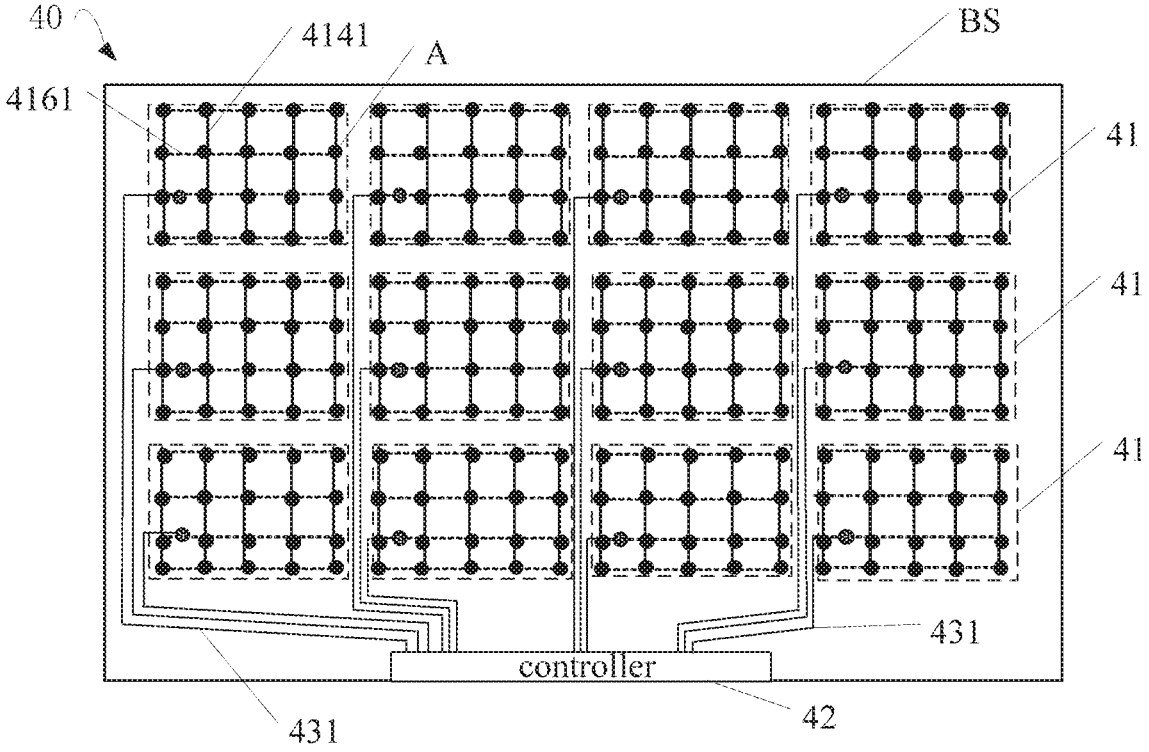
FIG. 4 is a schematic diagram illustrating a structure of a display panel according to an embodiment of the present disclosure.
Figure 5:
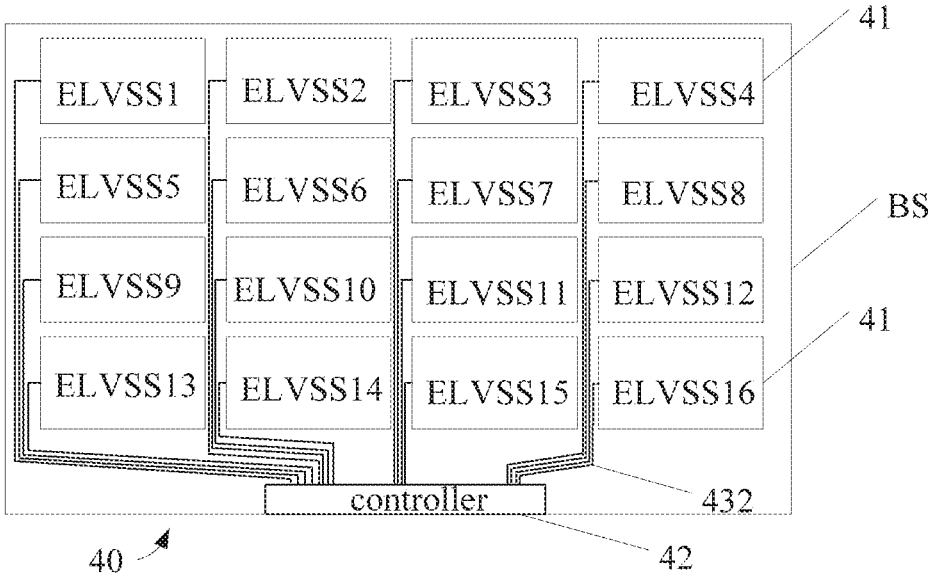
FIG. 5 is a schematic diagram illustrating another structure of a display panel according to an embodiment of the present disclosure.

In an aspect, the present disclosure provides a display panel. FIG. 4 is a schematic diagram illustrating a structure of a display panel according to an embodiment of the present disclosure; FIG. 5 is a schematic diagram illustrating another structure of a display panel according to an embodiment of the present disclosure; and FIG. 6 is a schematic diagram illustrating a structure of a pixel structure in FIG. 4.

Figure 6:
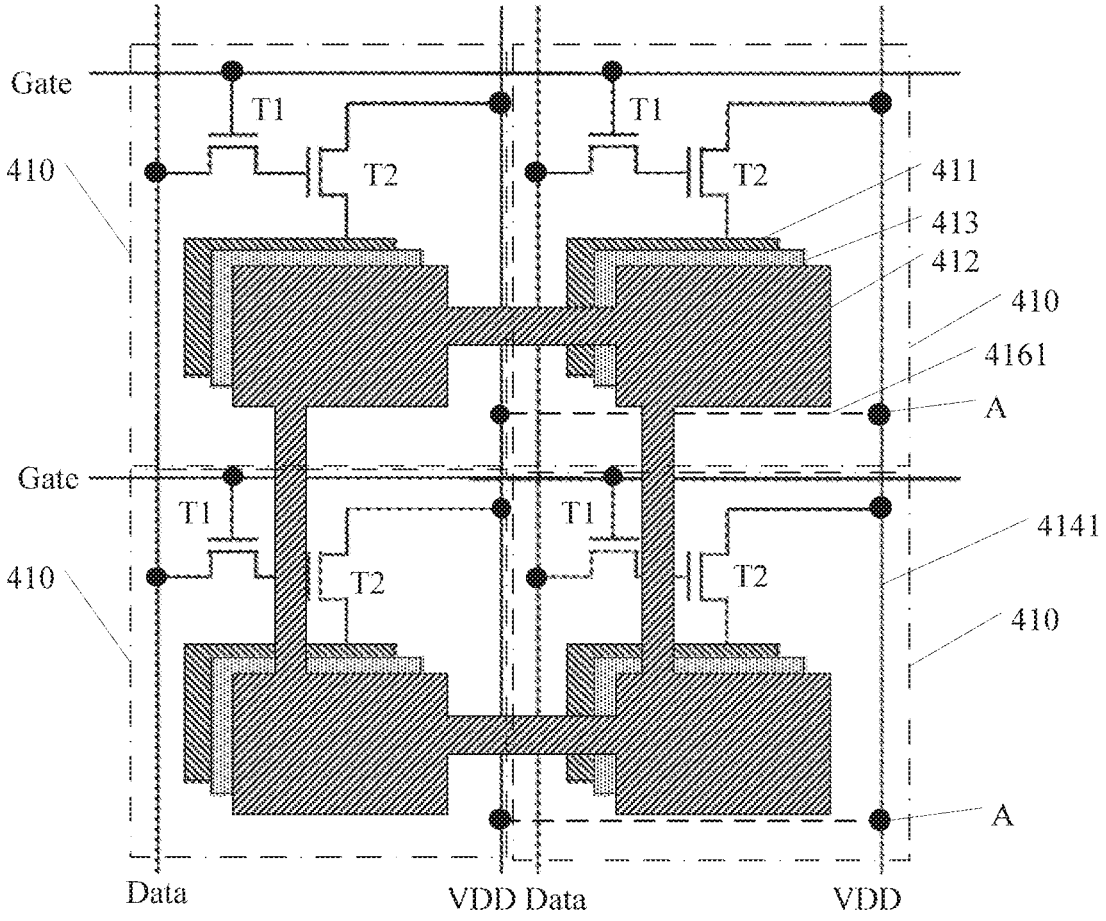
FIG. 6 is a schematic diagram illustrating a structure of a pixel structure in FIG. 4.

As illustrated in FIGS. 4 to 6, in some embodiments, a display panel 40 may have a plurality of pixel regions 41 and include a base substrate BS, a respective one of the plurality of pixel regions 41 has a plurality of pixel structures 410 provided on the base substrate BS, and a respective one of the plurality of pixel structures 410 includes an anode 411, a cathode 412, and a light emitting layer 413 between the anode 411 and the cathode 412. Here, the numbers of the pixel regions 41 and the pixel structures 410 are merely provided for illustration purpose, and the present disclosure is not limited thereto.

In some embodiments, the display panel 40 may further include a controller 42 and a plurality of power signal lines in a one-to-one correspondence with the plurality of pixel regions 41. The plurality of power signal lines may be a plurality of first power signal lines 431 as illustrated in FIG. 4, or may be a plurality of second power signal lines 432 as illustrated in FIG. 5. Anodes 411 or cathodes 412 of the plurality of pixel structures 410 in the respective one of the plurality of pixel regions 41 are each coupled to a respective one of the plurality of power signal lines, and the controller 42 is coupled with the plurality of power signal lines and configured to control a duty cycle of a control signal input to the respective one of the plurality of power signal lines in response to a motion picture being displayed in the respective one of the plurality of pixel regions 41.

Here, for example, the first power signal line 431 is an electroluminescent voltage device (ELVDD) signal line, and the second power signal line 432 is an electroluminescent voltage series (ELVSS) signal line. In some embodiments, the anodes 411 in the respective one of the plurality of pixel regions 41 are each coupled to a respective one of the plurality of first power signal lines 431, alternatively, the cathodes 412 in the respective one of the plurality of pixel regions 41 are each coupled to a respective one of the plurality of second power signal lines 432.

When the controller 42 detects that a motion picture is displayed in the respective one of the plurality of pixel regions 41, the controller 42 controls the duty cycle of the control signal input to the respective one of the plurality of power signal lines (the respective one of the plurality of first power signal lines 431 or the respective one of the plurality of second power signal lines 432). By adjusting the duty cycle of the control signal, a black picture is inserted into every frame of picture, and refresh time of every frame of picture is decreased, such that the grayscale to grayscale (GTG) response time is reduced, thereby alleviating the trail phenomenon.

The controller 42 may be a driver IC or any other component that can achieve a driving function.

Figure 7:
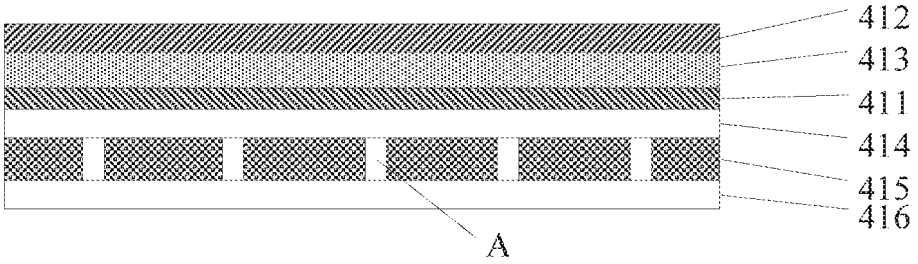
FIG. 7 is a partial cross-sectional view of a pixel structure in FIG. 4.

FIG. 7 is a partial cross-sectional view of a pixel structure in FIG. 4.

As illustrated in FIG. 7, in an embodiment of the present disclosure, the display panel further includes a first signal line layer 414, an insulation layer 415 and a second signal line layer 416 sequentially provided in a direction perpendicular to the base substrate BS (not illustrated in FIG. 7). The anode 411 is on a side of the first signal line layer 414 away from the second signal line layer 416.

As illustrated in FIGS. 4 and 7, in the respective one of the plurality of pixel regions 41, a plurality of first voltage signal lines 4141 arranged in columns are provided in the first signal line layer 414, the plurality of first voltage signal lines 4141 in the respective one of the plurality of pixel regions 41 are insulated and spaced apart (e.g., disconnected) from a plurality of first voltage signal lines 4141 in any other one of the plurality of pixel regions 41, and a respective one of the plurality of first voltage signal lines 4141 in the respective one of the plurality of pixel regions 41 is coupled to the anode 411. In the respective one of the plurality of pixel regions 41, a plurality of second voltage signal lines 4161 arranged in rows are provided in the second signal line layer 416, and the plurality of second voltage signal lines 4161 in the respective one of the plurality of pixel regions 41 are insulated and spaced apart from a plurality of second voltage signal lines 4161 in any other one of the plurality of pixel regions 41. In the respective one of the plurality of pixel regions 41, the plurality of first voltage signal lines 4141 are coupled with the plurality of second voltage signal lines 4161 through a plurality of vias A extending through the insulation layer 415. For example, as illustrated in FIG. 4, in the respective one of the plurality of pixel regions 41, the plurality of first voltage signal lines 4141 and the plurality of second voltage signal lines 4161 intersect to form a mesh structure, and the plurality of vias A are provided at the intersections of the mesh structure, respectively. Further, the mesh structure in the respective one of the plurality of pixel regions 41 is insulated and spaced apart from a mesh structure in any other one of the plurality of pixel regions 41, as illustrated in FIG. 4.

In an embodiment, the plurality of power signal lines in a one-to-one correspondence with the plurality of pixel regions 41 are the plurality of first power signal lines 431, and the plurality of first power signal lines 431 are provided in the first signal line layer 414 or the second signal line layer 416 of the display panel 40. The plurality of second voltage signal lines 4161 in the respective one of the plurality of pixel regions 41 are each coupled to the respective one of the plurality of first power signal lines 431.

By having the plurality of first voltage signal lines 4141 arranged in columns in the first signal line layer 414 in the respective one of the plurality of pixel regions 41, having the plurality of second voltage signal lines 4161 arranged in rows in the second signal line layer 416 in the respective one of the plurality of pixel regions 41, and coupling the plurality of first voltage signal lines 4141 with the plurality of second voltage signal lines 4161 through the plurality of vias A extending through the insulation layer 415, the uniformity of the voltage throughout the display panel can be improved.

It should be noted that FIG. 7 merely illustrates a positional relationship among the first signal line layer 414, the insulation layer 415, the second signal line layer 416, the anode 411, the cathode 412 and the light emitting layer 413, and in actual fabricating process, the structures of these layers may be not in accordance with the structures illustrated in FIG. 7. For example, the light emitting layer 413 from two adjacent pixel structures may be provided as two light emitting blocks in these two adjacent pixel structures, respectively, and these two light emitting blocks may be made of a same light emitting material or different light emitting materials.

As illustrated in FIG. 6, the display panel 40 further includes a plurality of gate lines Gate arranged in rows, a plurality of data lines Data arranged in columns, and a plurality of first voltage signal lines (VDD) 4141, wherein the data lines Data and the first voltage signal lines 4141 may be provided in a same layer, e.g., in the first signal line layer 414. As used herein, the term "in a same layer" refers to the relationship between the layers simultaneously formed in a same step. In one example, the data lines Data and the first voltage signal lines 4141 are in a same layer when they are formed as a result of one or more steps of a same patterning process performed on a same layer of material, in another example, the data lines Data and the first voltage signal lines 4141 can be formed in a same layer by simultaneously performing the step of forming the data lines Data and the step of forming the first voltage signal lines 4141. The term "in a same layer" does not always mean that the thicknesses of the layers or the heights of the layers in a cross-sectional view are the same.

In an embodiment, the respective one of the plurality of pixel structures 410 further includes a first transistor T1 and a second transistor T2. A gate electrode of the first transistor T1 is coupled to a respective one of the plurality of gate lines Gate, a source electrode of the first transistor T1 is coupled to a respective one of the plurality of data lines Data, and a drain electrode of the first transistor T1 is coupled to a gate of the second transistor T2, which has a source electrode coupled to a respective one of the plurality of first voltage signal lines (VDD) 4141 and a drain electrode coupled to the anode 411.

Here, the dotted lines in FIG. 6 represent the second voltage signal lines 4161 in the second signal layer 416, and the first voltage signal lines (VDD) 4141 are coupled to the second voltage signal lines 4161 through the vias A extending through the insulation layer 415.

When the anodes 411 in the respective one of the plurality of pixel regions 41 of the display panel 40 are each coupled to the respective one of the first voltage signal lines 431 (as illustrated in FIG. 4), the cathodes 412 of the pixel structures 410 of the display panel 40 are all coupled together (e.g., the cathodes 412 may be an integral metal layer extending throughout the whole display panel 40), and accordingly, the cathodes 412 in the display panel 410 are each coupled to one second power signal line (ELVSS) 432, the one second power signal line ELVSS is coupled to the controller 42 and a low voltage level signal is input to the one second power signal line ELVSS.

Figure 8:
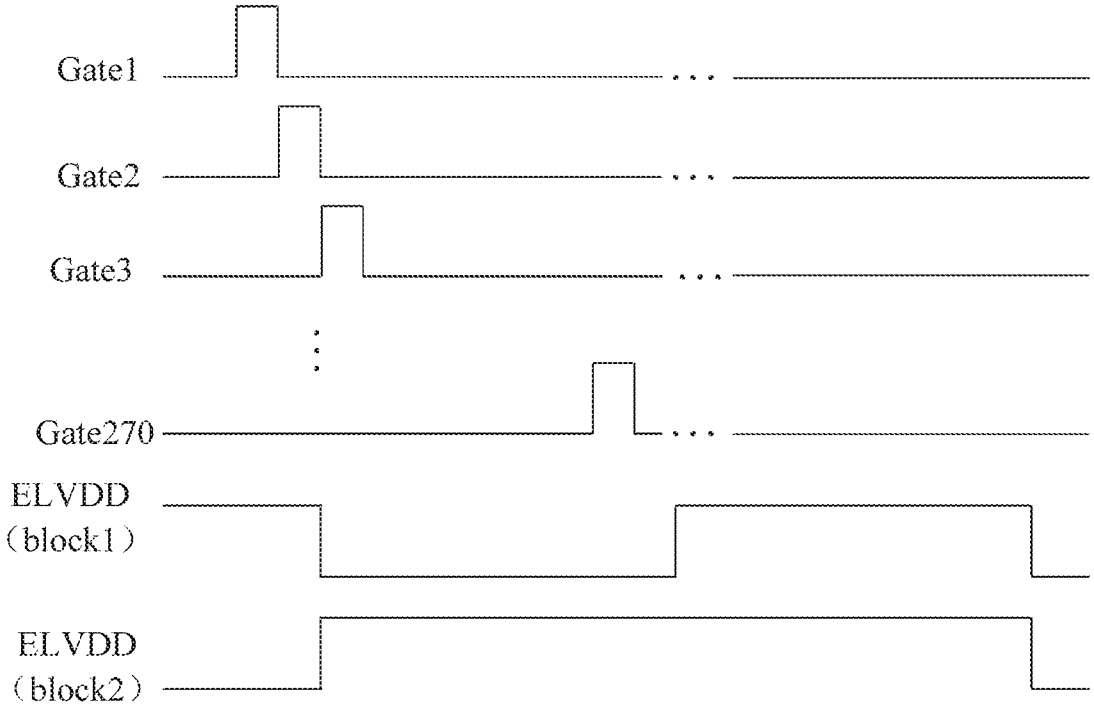
FIG. 8 is a driving timing diagram of the display panel illustrated in FIG. 4.

FIG. 8 is a driving timing diagram of the display panel illustrated in FIG. 4.

As illustrated in FIG. 4, the pixel regions 41 are arranged in an array having three rows and four columns. Herein, the numbers of rows and columns are merely for illustration purpose, and the present disclosure is not limited thereto. A first row of pixel regions 41 (the uppermost row of pixel regions 41) of the display panel 40, as illustrated in FIG. 4, includes 270 gate lines Gate, namely, gate line Gate1, gate line Gate2, gate line Gate3, . . . , gate line Gate270, which drive, from top to bottom, 270 rows of pixel structures 410 in the first row of pixel regions 41 to emit light, respectively.

With respect to the first row of pixel regions 41, when a motion picture is displayed in the first pixel region 41 (i.e., block1) from left to right and a still picture is displayed in the second pixel region 41 (i.e., block2) from left to right, the duty cycle of the control signal input to the first power signal line (ELVDD) 431 coupled to block1 is adjusted from 100% to 50% as illustrated in FIG. 8, such that when the control signal input to the first power signal line ELVDD is at a low level, the plurality of pixel structures 410 in block1 each display a black picture, and when the control signal input to the first power signal line ELVDD is at a high level, the plurality of pixel structures 410 in block1 each display a normal picture. By lowering the duty cycle, the trail phenomenon in block1 is alleviated. Meanwhile, the duty cycle of the control signal input to the first power signal line (ELVDD) 431 coupled to block2 remains unchanged, i.e., as 100%.

Here, the duty cycle refers to a fraction of the operating cycle of the circuit in which the circuit is turned on in a ratio of the time during which a high level is input to the time taken by one frame of picture.

By lowering the duty cycle of the control signal input to the first power signal line ELVDD, the power consumption of the display panel can also be lowered.

Figure 9:
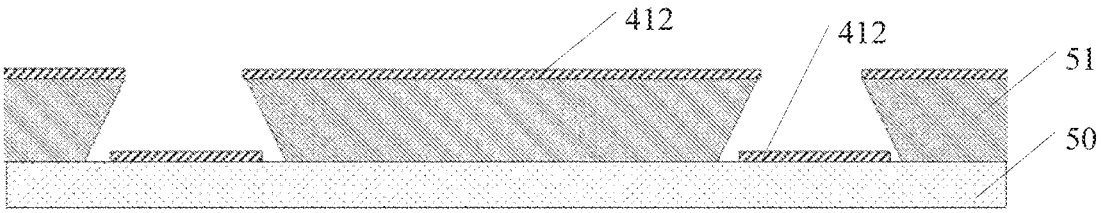
FIG. 9 is a schematic diagram illustrating an exemplary structure of a cathode in FIG. 5.

FIG. 9 is a schematic diagram illustrating an exemplary structure of a cathode in FIG. 5.

In another embodiment of the present disclosure, the cathodes in any two pixel regions may be insulated and spaced apart (e.g., disconnected) from each other, so that the pixel structures in each pixel region are controlled individually to realize a region-based driving (i.e. driving by region). As illustrated in FIGS. 5 and 9, in a case where the plurality of power signal lines in a one-to-one correspondence with the plurality of pixel regions 41 are the plurality of second power signal lines (ELVSS) 432, cathodes 412 in a respective one of the plurality of pixel regions 41 are insulated and spaced apart from cathodes 412 in any other one of the plurality of pixel regions 41, and the cathodes 412 in the respective one of the plurality of pixel regions 41 is coupled to a respective one of the plurality of second power signal lines (ELVSS) 432.

In the display panel 40 as illustrated in FIG. 5, ELVSS1 represents that the cathodes 412 in that pixel region 41 are each coupled to a same second power signal line ELVSS1, ELVSS2 represents that the cathodes 412 in that pixel region 41 are each coupled to a same second power signal line ELVSS2, and so on, and ELVSS6 represents that the cathodes 412 in that pixel region 41 are each coupled to a same second power signal line ELVSS6.

By coupling the cathodes 412 in a same pixel region 41 to a same second power signal line 432, the pixel structures in the same pixel region 41 can be easily controlled to display a black picture in a subsequent process. Moreover, compared to the related art in which all the cathodes 412 in the display panel 40 are coupled to one second power signal line, the uniformity of the display panel 40 will not be largely lowered.

As illustrated in FIG. 9, the display panel 40 further includes a driving substrate 50 in which the formation of the light emitting layer is completed. The driving substrate 50 may be formed by sequentially forming a buffer layer, a polycrystalline silicon layer, a gate insulation layer, a gate metal layer, a spacer layer, a data line metal layer, a cathode, a resin definition layer, a light emitting layer and the like. For example, a resin layer 51 may be formed by applying, exposing, developing a positive photoresist material on the light emitting layer of the driving substrate 50. The resin layer 51 may include a plurality of resin blocks arranged at intervals. A respective one of the plurality of resin blocks is in a respective one of the plurality of pixel regions, and a cross section of the respective one of the plurality of resin blocks along a plane perpendicular to the base substrate has an inverted trapezoidal shape.

A cathode metal material may be deposited on the resin layer 51, and the cathode metal material may be naturally disconnected at edges of the resin blocks having inverted trapezoidal shapes, so that the cathodes 412 in any two pixel regions 41 are disconnected. As a result, the cathode metal material is divided into blocks to form a plurality of cathodes 412.

The plurality of resin blocks arranged at intervals are provided on the light emitting layer 413 of the display panel 40, and the cathodes 412 are on the resin blocks arranged at intervals and between two adjacent ones of the resin blocks arranged at intervals (i.e., on the light emitting layer 413). For example, the cathodes 412 in the respective one of the plurality of pixel regions 41 are on the respective one of the plurality of resin blocks and between the respective one of the plurality of resin blocks and an adjacent respective one of the plurality of the resin blocks.

Figure 10:
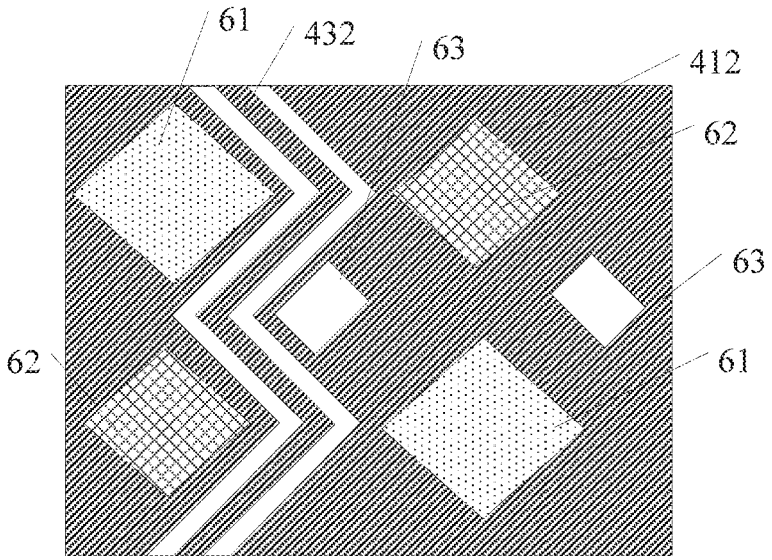
FIG. 10 is a schematic diagram illustrating a position of a second power signal line in FIG. 5.

FIG. 10 is a schematic diagram illustrating a position of a second power signal line 432 in FIG. 5.

The pixel structures 410 in the pixel region 41 has a certain gap (a width of which is generally from about 20 μm to about 40 μm) therebetween in the fabricating process, and accordingly, adjacent two pixel regions 41 has a gap having a width from about 20 μm to about 40 μm therebetween. The second power signal line (ELVSS) 432 may be provided at the gap between the adjacent two pixel regions 41 without increasing the bezel width of the display panel.

"61" represents a pixel structure 410 in the pixel region 41, and the light emitting layer 413 thereof is made of a blue light emitting material, "62" represents a pixel structure 410 in the pixel region 41, and the light emitting layer 413 thereof is made of a red light emitting material, and "63" represents a pixel structure 410 in the pixel region 41, and the light emitting layer 413 thereof is made of a green light emitting material.

From FIG. 10 it can be seen that, the cathodes 412 from the two adjacent pixel regions 41 are insulated and spaced apart from each other, and the second power signal line (ELVSS) 432 and the cathodes 412 may be made of a same material or different materials.

Figure 11:
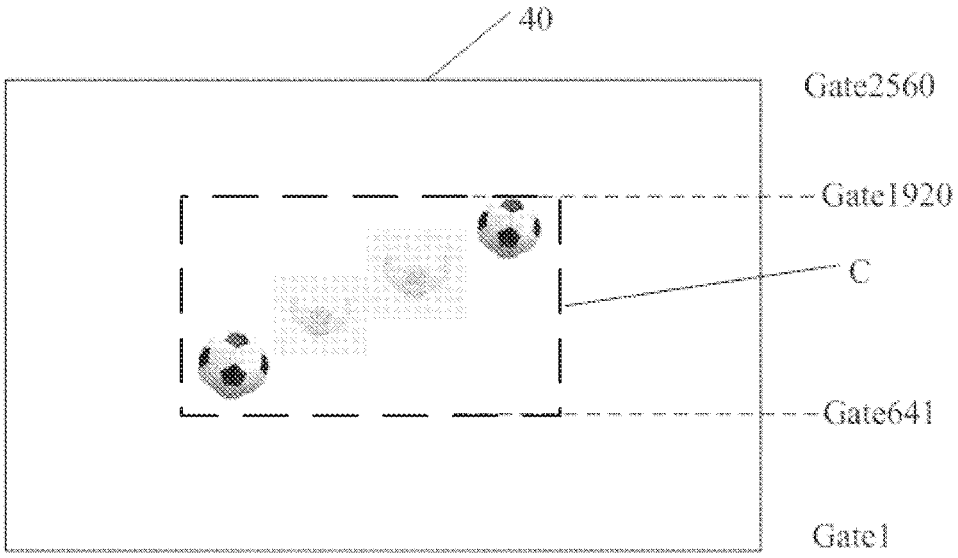
FIG. 11 is a schematic diagram illustrating a motion picture being displayed in the display panel illustrated in FIG. 5.
Figure 12:
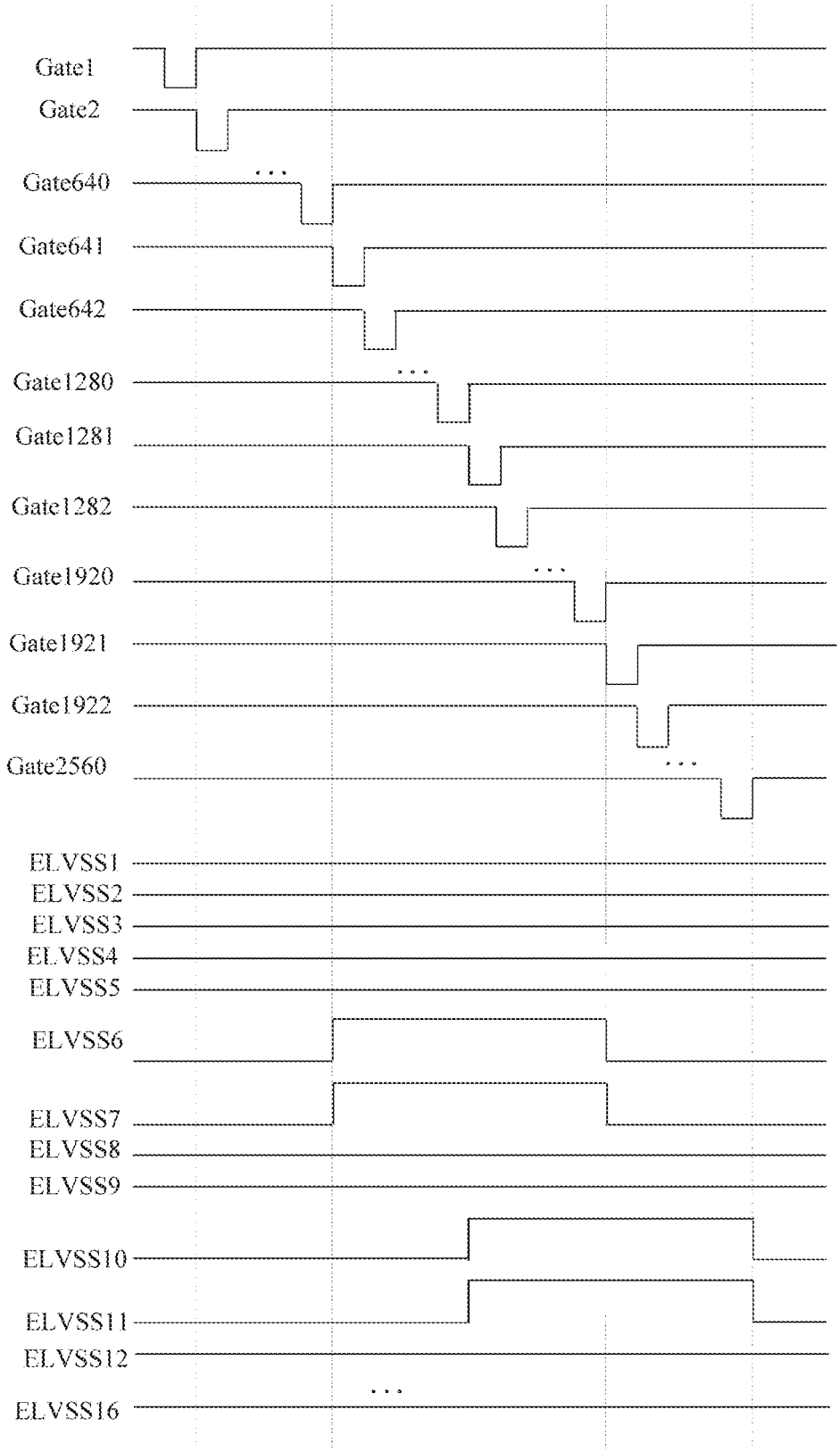
FIG. 12 is a driving timing diagram of displaying a motion picture as illustrated in FIG. 11.

FIG. 11 is a schematic diagram illustrating a motion picture being displayed in the display panel illustrated in FIG. 5; and FIG. 12 is a driving timing diagram of displaying a motion picture as illustrated in FIG. 11.

When a motion picture (which is a moving football) is displayed in a region C of the display panel, the movement of the football is mainly presented in the pixel regions 41 corresponding to ELVSS6, ELVSS7, ELVSS10 and ELVSS11 of the display panel in FIG. 5.

The display panel 40 includes 2560 gate lines, namely, gate lines Gate1 to Gate640 corresponding to the first row of pixel regions 41 from bottom to top, gate lines Gate641 to Gate1280 corresponding to the second row of pixel regions 41 front bottom to top, gate lines Gate1281 to Gate1920 corresponding to the third row of pixel regions 41 from bottom to top, and gate lines Gate1921 to Gate2560 corresponding to the fourth row of pixel regions 41 from bottom to top.

The picture displayed in the display panel 40 may be refreshed from bottom to top, which means that the 2560 rows of pixel structures 410 are driven to emit light from bottom to top. Since a still picture is displayed in the pixel regions 41 corresponding to ELVSS1 to ELVSS5, ELVSS8, ELVSS9 and ELVSS12 to ELVSS16, the control signals input to ELVSS1 to ELVSS5, ELVSS8, ELVSS9 and ELVSS12 to ELVSS16 are low level signals, the duty cycles of which are 0% and remain unchanged.

Since the motion picture is displayed in the pixel regions 41 corresponding to ELVSS6, ELVSS7, ELVSS10 and ELVSS11, the duty cycles of the control signals input to ELVSS6, ELVSS7, ELVSS10 and ELVSS11 are adjusted, e.g., from 0% to 50%. When the control signals input to ELVSS6, ELVSS7, ELVSS10 and ELVSS11 are at a low level, the picture is normally displayed in the corresponding pixel regions, and when the control signals input to ELVSS6, ELVSS7, ELVSS10 and ELVSS11 are at a high level, a black picture is displayed in the corresponding pixel regions, namely, the black picture is inserted.

In a case where the cathodes 412 in a respective one of the plurality of pixel regions 41 of the display panel are each coupled to a respective one of the plurality of second power signal lines 432 (as illustrated in FIG. 5), only a plurality of first voltage signal lines 4141 arranged in columns are provided in the first signal line layer 414, and the plurality of first voltage signal lines 4141 arranged in columns are directly coupled to the controller without the need to fabricate the second signal line layer 416 and the second voltage signal lines 4161. Moreover, the first voltage signal lines 4141 in any two pixel regions 41 are not required to be insulated and spaced apart from each other.

Furthermore, the display panel as illustrated in FIG. 5 further includes a plurality of gate lines Gate arranged in rows, a plurality of data lines Data arranged in columns, and a plurality of first voltage signal lines (VDD) 4141 arranged in columns in the first signal line layer 414, wherein the data lines Data and the first voltage signal lines 4141 are provided in a same layer, i.e., in the first signal line layer 414.

Furthermore, the display panel as illustrated in FIG. 5 may also include a first transistor T1 and a second transistor T2. A gate electrode of the first transistor T1 is coupled to a respective one of the plurality of gate lines Gate, a source electrode of the first transistor T1 is coupled to a respective one of the plurality of data lines Data, and a drain electrode of the first transistor T1 is coupled to a gate of the second transistor T2, which has a source electrode coupled to a respective one of the plurality of first voltage signal lines (VDD) 4141 and a drain electrode coupled to the anode 411.

The pixel structure of the display panel illustrated in FIG. 5 is different from the pixel structure 410 illustrated in FIG. 6 in that, the second signal line layer 416 and the second voltage signal lines 4161 are not required, the cathodes 412 in a same pixel region 41 are coupled to each other, and the cathodes 412 from dale rent pixel regions 41 are insulated and spaced apart from each other.

In above embodiments, the duty cycle of the control signal input to the power signal line is 50%, but this is merely an example, the present disclosure is not limited thereto. In other embodiments of the present disclosure, the duty cycle of the control signal input to the first power signal line 431 ranges from about 10% to about 80%, or the duty cycle of the control signal input to the second power signal line 432 ranges from about 10% to about 80%.

In above embodiments, the number of the pixel regions 41 of the display panel 40 illustrated in FIG. 4 is 12, and the number of the pixel regions 41 of the display panel 40 illustrated in FIG. 5 is 16, which merely illustrate examples of the number of the pixel regions 41, and the present disclosure is not limited thereto. In other embodiments of the present disclosure, the number of the pixel regions of the whole display panel 40 may be from 2 to 16. The larger the number of the pixel regions 41, the better the trail phenomenon is alleviated. However, in order to ensure that the number of the lines, which are coupled to the controller, in the peripheral area of the display panel is not excessively large so as to prevent increase of the bezel width of the display panel due to the excessively large number of the lines, the number of the pixel regions is set from 2 to 16.

In the embodiments of the present disclosure, by dividing the display panel into a plurality of pixel regions, providing in the display panel the controller and the power signal lines in a one-to-one correspondence with the pixel regions, coupling anodes or cathodes in a same pixel region to a same power signal line, and coupling the controller with the power signal lines, when a motion picture is displayed in a pixel region, the duty cycle of the control signal input to a power signal line coupled with the pixel region is controlled. By dividing the display panel into a plurality of pixel regions, each of which is controlled individually, when a motion picture is displayed in a display region, the duty cycle of the control signal input to a power signal line coupled with the pixel region is adjusted, so that the grayscale to grayscale response time is reduced, thereby alleviating the trail phenomenon. Moreover, the power consumption is not significantly increased.

In another aspect, the present disclosure further provides a display apparatus, which includes the display panel 40 described herein.

The detailed description of the display panel 40 may refer to the descriptions made in the above embodiments and will not be repeated here.

In actual applications, the display apparatus may be any product or part having a display function, such as a mobile phone, a tablet computer, a television, a monitor, a laptop computer, a navigator or the like.

The display apparatus according to the embodiments of the present disclosure may be applied to near-eye display technologies such as virtual reality (VR) technology. For the near-eye display technologies, the requirement on the brightness of the display apparatus is not strict, but they are sensitive to the trail phenomenon. The user may have obvious dizziness and uncomfortable feelings even when the trail phenomenon is slight. Accordingly, the dizziness due to the trail phenomenon can be relieved by applying the display apparatus according to the embodiments of the present disclosure to the near-eye display technologies.

In the embodiments of the present disclosure, the display apparatus includes the display panel. By dividing the display panel into a plurality of pixel regions, providing in the display panel the controller and the power signal lines in a one-to-one correspondence with the pixel regions, coupling anodes or cathodes in a same pixel region to a same power signal line, and coupling the controller with the power signal lines, when a motion picture is displayed in a pixel region, the duty cycle of the control signal input to a power signal line coupled with the pixel region is controlled. By dividing the display panel into a plurality of pixel regions, each of which is controlled individually, when a motion picture is displayed in a display region, the duty cycle of the control signal input to a power signal line coupled with the pixel region is adjusted, so that the grayscale to grayscale response time is reduced, thereby alleviating die trail phenomenon. Moreover, the power consumption is not significantly increased.

Figure 13:
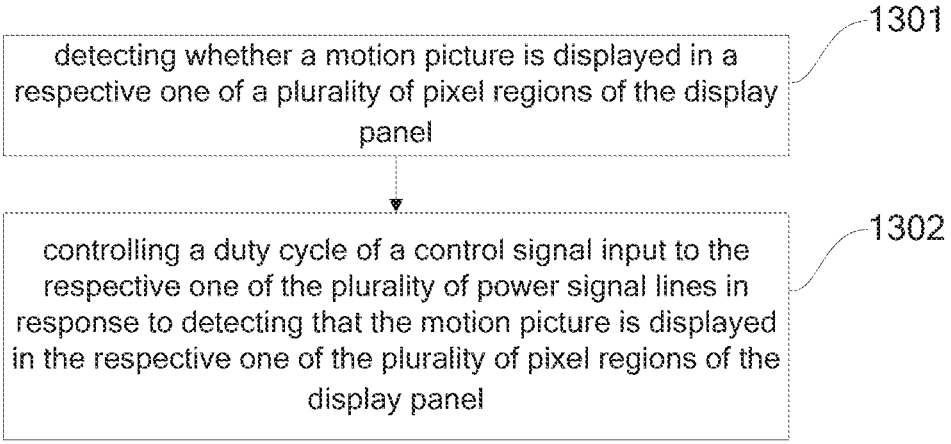
FIG. 13 is a flow chart illustrating a method of driving a display panel according to an embodiment of the present disclosure.

In another aspect, the present disclosure further provides a method of driving a display panel. FIG. 13 is a flow chart illustrating a method of driving a display panel according to an embodiment of the present disclosure. The display panel may be arty one of the display panels described herein. In some embodiments, the method may include steps 1301 and 1302.

In step 1301, whether a motion picture is displayed in a respective one of a plurality of pixel regions of the display panel is detected.

In an embodiment of the present disclosure and referring to FIGS. 4 to 6, a display panel 40 is divided into a plurality of pixel regions 41, and a controller 42 and a plurality of power signal lines in a one-to-one correspondence with the plurality of pixel regions 41 are provided in the display panel. Anodes or cathodes in the respective one of the plurality of pixel regions are each coupled to a respective one of the plurality of power signal lines, and the controller 42 is coupled with the plurality of power signal lines.

Whether the motion picture is displayed in the respective one of the plurality of pixel regions of the display panel is detected by the controller 42.

In step 1302, a duty cycle of a control signal input to the respective one of the plurality of power signal lines is controlled in response to detecting that the motion picture is displayed in the respective one of the plurality of pixel regions of the display panel.

In the embodiments of the present disclosure, when the controller 42 detects that a motion picture is displayed in the respective one of the plurality of pixel regions 41, the controller 42 controls the duty cycle of the control signal input to the respective one of the plurality of power signal lines (the respective one of the plurality of first power signal lines 431 or the respective one of the plurality of second power signal lines 432). By adjusting the duty cycle of the control signal, a black picture is inserted into every frame of picture, and refresh time of every frame of picture is decreased, such that the grayscale to grayscale (GTG) response time is reduced, thereby alleviating the trail phenomenon.

When a still picture is displayed in the respective one of the plurality of pixel regions 41, the duty cycle of the control signal input to the respective one of the plurality of power signal lines does not need to be adjusted.

In an example, for any one frame of picture, a low voltage level signal is input to the respective one of the plurality of power signal lines during a first period; and a high voltage level signal is input to the respective one of the plurality of power signal lines during a second period. Optionally, the first period and the second period substantially constitute a duration of one frame of picture, i.e., duration of displaying one frame of picture without applying the embodiments of the present disclosure.

In an embodiment of the present disclosure, when a motion picture is displayed in a pixel region, for any one frame of picture in the motion picture, a low voltage level signal is input to the power signal line coupled to the pixel region during the first period. For example, for the display panel 40 as illustrated in FIG. 4, a low voltage level signal is input to the first power signal line 431, while a low voltage level signal is also input to the second voltage signal line 432, so that a black picture is displayed in the pixel region of the display panel 40 during the first period. For another example, for the display panel 40 as illustrated in FIG. 5, a low voltage level signal is input to the second power signal line 432, while a high voltage level signal is input to the first power signal line 431, so that a normal picture is displayed in the pixel region of the display panel 40 during the first period.

A high voltage level signal is input to the power signal line coupled to the pixel region during the second period. For example, for the display panel 40 as illustrated in FIG. 4, a high voltage level signal is input to the first power signal line 431, while a low voltage level signal is input to the second voltage signal line 432, so that a normal picture is displayed in the pixel region of the display panel 40 during the second period. For another example, for the display panel 40 as illustrated in FIG. 5, a high voltage level signal is input to the second power signal line 432, while a high voltage level signal is also input to the first power signal line 431, so that a black picture is displayed in the pixel region of the display panel 40 during the second period.

In some embodiments, the duty cycle of the control signal is controlled such that the duty cycle is in a range of about 10% to about 80%.

In some embodiments, a data voltage input to the data line of the display panel is controlled (e.g., increased) in response to detecting that a motion picture is displayed in the respective one of the plurality of pixel regions, such that the luminance of the plurality of pixel structures in the respective one of the plurality of pixel regions is compensated for.

In an embodiment of the present disclosure, during adjustment of the duty cycle of the control signal, because a black picture is inserted in each frame of picture, refresh time of each frame of picture is decreased, and the display luminance of each frame of picture is accordingly reduced, the data voltage input to the data line Data of the display panel 40 is increased to compensate for the luminance of the plurality of pixel structures 410 in the pixel region 41.

In the embodiments of the present disclosure, whether a motion picture is displayed in a pixel region of the display panel is detected, and when the motion picture is displayed in the pixel region, the duty cycle of the control signal input to the power signal line is controlled. By dividing the display panel into a plurality of pixel regions, each of which is controlled individually, when a motion picture is displayed in a display region, the duty cycle of the control signal input to the power signal line coupled with the pixel region is adjusted, so that the grayscale to grayscale response time is reduced, thereby alleviating the trail phenomenon. Moreover, the power consumption is not significantly increased.

For the foregoing embodiments of the method, for the sake of simple description, they are all described as a combination of a series of actions, but those skilled in the art should understand that the present disclosure is not limited by the described action sequence, and these steps can be performed in other orders or simultaneously according to the present disclosure. Furthermore, those skilled in the art should also understand that the embodiments described in the specification are exemplary embodiments, and the actions and modules involved are not necessarily required by the present disclosure.

The various embodiments in the present specification are described in a progressive manner, and each embodiment focuses on differences from other embodiments, and the same or similar parts between the various embodiments can be referred to each other.

Finally, it should also be noted that in this context, relational terms such as first and second are used merely to distinguish one entity or operation from another entity or operation, and do not necessarily require or imply that there is any such actual relationship or order between these entities or operations. Furthermore, the terms "comprise", "include" or any other variations are intended to encompass a non-exclusive inclusion, such that a process, method, item, or apparatus including elements not only includes the elements, but also includes other elements that are not explicitly listed or elements that are inherent to such process, method, item, or apparatus. Without any other limitation, an element defined by the phrase "comprise a . . . " does not exclude the presence of additional equivalent elements in the process, method, item, or apparatus including the element.

In the foregoing descriptions, the display panel, the method of driving the same and the display apparatus provided by the present disclosure are described in detail. The principles and embodiments of the present disclosure are described in the specific examples. It is to be understood that the above embodiments are merely exemplary embodiments for the purpose of explaining the principles of the present disclosure, but the present disclosure is not limited thereto. Various modifications and improvements can be made by those skilled in the art without departing from the spirit and scope of the present disclosure. These modifications and improvements are also considered to be within the protection scope of the present disclosure.

What is claimed is:

1. A display panel having a plurality of pixel regions and comprising a base substrate, a respective one of the plurality of pixel regions having a plurality of pixel structures provided on the base substrate, and a respective one of the plurality of pixel structures comprising an anode, a cathode and a light emitting layer between the anode and the cathode, wherein the display panel further comprises a controller, and a plurality of power signal lines in a one-to-one correspondence with the plurality of pixel regions, anodes or cathodes of the plurality of pixel structures in the respective one of the plurality of pixel regions are each coupled to a respective one of the plurality of power signal lines, and the controller is coupled with the plurality of power signal lines and configured to change a duty cycle of a control signal input to the respective one of the plurality of power signal lines in response to a motion picture being displayed in the respective one of the plurality of pixel regions, and keep the duty cycle of the control signal input to the respective one of the plurality of power signal lines unchanged in response to a still picture being displayed in the respective one of the plurality of pixel regions, and wherein the display panel further comprises a first signal line layer, an insulation layer and a second signal line layer sequentially provided in a direction perpendicular to the base substrate, the anode being on a side of the first signal line layer away from the second signal line layer, wherein in the respective one of the plurality of pixel regions, a plurality of first voltage signal lines arranged in columns are provided in the first signal line layer, the plurality of first voltage signal lines in the respective one of the plurality of pixel regions are insulated and spaced apart from a plurality of first voltage signal lines in any other one of the plurality of pixel regions, and a respective one of the plurality of first voltage signal lines in the respective one of the plurality of pixel regions is coupled to the anode;

in the respective one of the plurality of pixel regions, a plurality of second voltage signal lines arranged in rows are provided in the second signal line layer, the plurality of second voltage signal lines in the respective one of the plurality of pixel regions are insulated and spaced apart from a plurality of second voltage signal lines in any other one of the plurality of pixel regions, and in the respective one of the plurality of pixel regions, the plurality of first voltage signal lines are directly coupled with the plurality of second voltage signal lines through a plurality of vias extending through the insulation layer; and the plurality of power signal lines are a plurality of first power signal lines, the plurality of first power signal lines are provided in the first signal line layer or the second signal line layer, and the plurality of second voltage signal lines in the respective one of the plurality of pixel regions are directly coupled to a respective one of the plurality of first power signal lines.

2. The display panel of claim 1, wherein in the respective one of the plurality of pixel regions, the plurality of first voltage signal lines and the plurality of second voltage signal lines are provided to intersect to form a mesh structure, and the plurality of vias are provided at intersections of the mesh structure, respectively, and the mesh structure in the respective one of the plurality of pixel regions is insulated and spaced apart from a mesh structure in any other one of the plurality of pixel regions.

3. The display panel of claim 1, wherein the display panel is an organic light emitting diode display panel, and the plurality of first power signal lines are a plurality of electroluminescent voltage device signal lines.

4. The display panel of claim 1, wherein the cathodes are an integral cathode extending throughout the display panel and the integral cathode is coupled with the controller through a signal line.

5. A display panel having a plurality of pixel regions and comprising a base substrate, a respective on of the plurality of pixel regions having a plurality of pixel structures provided on the base substrate, and a respective one of the plurality of pixel structures comprising an anode, a cathode and a light emitting layer between the anode and the cathode, wherein the display panel further comprises a controller, and a plurality of power signal lines in a one-to-one correspondence with the plurality of pixel regions, anodes or cathodes of the plurality of pixel structures in the respective one of the plurality of pixel regions are each coupled to a respective one of the plurality of power signal lines, and the controller is coupled with the plurality of power signal lies and configured to change a duty cycle of a control signal input to the respective one of the plurality of power signal lines in response to a motion picture being displayed in the respective one of the plurality of pixel regions, and keep the duty cycle of the control signal input to the respective one of the plurality of power signal lines unchanged in response to a still picture being displayed in the respective one of the plurality of pixel regions, and wherein the cathodes in the respective one of the plurality of pixel regions are insulated and spaced apart from cathodes in any other one of the plurality of pixel regions, the plurality of power signal lines are a plurality of second power signal lines, and the cathodes in the respective one of the plurality of pixel regions are coupled to a respective one of the plurality of second power signal lines.

6. The display panel of claim 5, wherein a respective one of the plurality of second power signal lines is provided at a gap between two adjacent pixel regions of the plurality of pixel regions.

7. The display panel of claim 6, wherein the gap between the two adjacent pixel regions of the plurality of pixel regions has a width in a range of about 20 μm to about 40 μm.

8. The display panel of claim 5, further comprising a resin layer comprising a plurality of resin blocks arranged at intervals, wherein a respective one of the plurality of resin blocks is in the respective one of the plurality of pixel regions and on the light emitting layer; and the cathodes in the respective one of the plurality of pixel regions are on the respective one of the plurality of resin blocks and between the respective one of the plurality of resin blocks and an adjacent one of the plurality of the resin blocks.

9. The display panel of claim 8, wherein a cross section of the respective one of the plurality of resin blocks along a plane perpendicular to the base substrate has an inverted trapezoidal shape.

10. The display panel of claim 5, wherein the display panel is an organic light emitting diode display panel, and the plurality of second power signal lines are a plurality of electroluminescent voltage series signal lines.

11. The display panel of claim 1, wherein the duty cycle of the control signal is from about 10% to about 80%.

12. The display panel of claim 1, wherein a number of the plurality of pixel regions is from 2 to 16.

13. A display apparatus, comprising the display panel of claim 1.

14. A method of driving a display panel having a plurality of pixel regions and comprising a base substrate, a respective one of the plurality of pixel regions having a plurality of pixel structures provided on the base substrate, and a respective one of the plurality of pixel structures comprising an anode, a cathode and a light emitting layer between the anode and the cathode;

the display panel further comprising a controller, and a plurality of power signal lines in a one-to-one correspondence with the plurality of pixel regions, anodes of the plurality of pixel structures in the respective one of the plurality of pixel regions being each coupled to a respective one of the plurality of power signal lines, and the controller being coupled with the plurality of power signal lines, wherein the display panel further comprises a first signal line layer, and insulation layer and a second signal line layer sequentially provided in a direction perpendicular to the base substrate, the anode being on a side of the first signal line layer away from the second signal line layer, wherein in the respective one of the plurality of pixel regions, a plurality of first voltage signal lines arranged in columns are provided in the first signal line layer, the plurality of first voltage signal lines in the respective one of the plurality of pixel regions are insulated and spaced apart from a plurality of first voltage signal lines in any other one of the plurality of pixel regions, and a respective one of the plurality of first voltage signal lines in the respective one of the plurality of pixel regions is coupled to the anode;

in the respective one of the plurality of pixel regions, a plurality of second voltage signal lines arranged in rows are provided in the second signal line layer, they plurality of second voltage signal lines in the respective one of the plurality of pixel regions are insulated and spaced apart from a plurality of second voltage signal lines in any other one of the plurality of pixel regions, and in the respective one of the plurality of pixel regions, the plurality of first voltage signal lines are directly coupled with the plurality of second voltage signal lines through a plurality of vias extending through the insulation layer; and the plurality of power signal lines are a plurality of first power signal lines, the plurality of first power signal lines are provided in the first signal line layer or the second signal line layer, and the plurality of second voltage signal lines in the respective one of the plurality of pixel regions are directly coupled to a respective one of the plurality of first power signal lines, wherein the method comprises:

detecting, by the controller, whether a motion picture is displayed in the respective one of the plurality of pixel regions;

changing, by the controller, a duty cycle of a control signal input to the respective one of the plurality of power signal lines, in response to detecting that the motion picture is displayed in the respective one of the plurality of pixel regions; and keeping, by the controller, the duty cycle of the control signal input to the respective one of the plurality of power signal lines unchanged, in response to detecting that a still picture is displayed in the respective one of the plurality of pixel regions.

15. The method of claim 14, wherein controlling the duty cycle of the control signal input to the respective one of the plurality of power signal lines comprises:

for any frame of picture, inputting a low voltage level signal to the respective one of the plurality of power signal lines during a first period; and inputting a high voltage level signal to the respective one of the plurality of power signal lines during a second period.

16. The method of claim 14, wherein the duty cycle of the control signal is controlled such that the duty cycle is in a range of about 10% to about 80%.

17. The method of claim 14, further comprising:

controlling a data voltage input to a data line of the display panel in response to detecting that the motion picture is displayed in the respective one of the plurality of pixel regions such that luminance of the plurality of pixel structures in the respective one of the plurality of pixel regions is compensated for.

18. A method of driving a display panel, wherein the display panel is the display panel of claim 5, and the method comprises:

detecting, by the controller, whether a motion picture is displayed in the respective one of the plurality of pixel regions;

changing, by the controller, a duty cycle of a control signal input to the respective one of the plurality of power signal lines, in response to detecting that the motion picture is displayed in the respective one of the plurality of pixel regions; and keeping, by the controller, the duty cycle of the control signal input to the respective one of the plurality of power signal lines unchanged, in response to detecting that a still picture is displayed in the respective one of the plurality of pixel regions.

19. The display panel of claim 5, wherein the duty cycle of the control signal is from about 10% to about 80%, or wherein a number of the plurality of pixel regions is from 2 to 16.

20. A display apparatus, comprising the display panel of claim 5.

* * * * *